United States Patent [19]

Czirr et al.

[11] 3,935,118

[45] Jan. 27, 1976

[54] NITRIC ACID SYSTEM FOR ETCHING MAGNESIUM PLATES

[75] Inventors: David L. Czirr, Cresskill, N.J.; Harry Kroll, Warwick, R.I.

[73] Assignee: Philip A. Hunt Chemical Corporation, Palisades Park, N.J.

[22] Filed: Feb. 11, 1974

[21] Appl. No.: 441,342

Related U.S. Application Data

[63] Continuation-in-part of Ser. No. 337,879, March 5, 1973, abandoned.

[52] U.S. Cl. ..... 252/79.4; 156/14

[51] Int. Cl.[2] ..... C09K 13/06

[58] Field of Search ..... 156/7, 8, 14; 252/79.1, 252/79.2, 79.4

[56] References Cited

UNITED STATES PATENTS 3,725,158 4/1973 Messerschmidt et al. ..... 156/14

*Primary Examiner*—William A. Powell
*Assistant Examiner*—Brian J. Leitten
*Attorney, Agent, or Firm*—Kirschstein, Kirschstein, Ottinger & Frank

[57] ABSTRACT

A one-step powderless high-speed process for producing photoengraved letter-press printing and pattern plates from magnesium and alloys thereof by etching such plates in a machine that directs against a surface of the plate droplets of an etching liquid comprising an aqueous solution of a strong inorganic acid and adjuvants.

56 Claims, 6 Drawing Figures

NITRIC ACID SYSTEM FOR ETCHING MAGNESIUM PLATES

CROSS-REFERENCE TO RELATED APPLICATION

This application is a continuation-in-part of application Ser. No. 337,879 filed Mar. 5, 1973, now abandoned, for NITRIC ACID SYSTEM FOR ETCHING MAGNESIUM PLATES.

BACKGROUND OF THE INVENTION

1. Field of the Invention

Strong inorganic acid system for etching plates of magnesium and alloys thereof.

2. Description of the Prior Art

Magnesium (the term "magnesium" as used herein denotes magnesium with trace impurities and magnesium alloys, the same frequently being alloyed with zinc; such alloys include at least 70% magnesium and preferably at least 95% magnesium) printing and pattern plates are produced, by etching, from metal coated, in the present state of the art, with a light-sensitive coating which has been transformed by the action of light, with or without the assistance of heat, in certain areas, into an etch-resist pattern known as a photoresist pattern, the remainder of the coating having been removed, as by dissolving, to leave bare metal areas.

An image is produced on a surface of a metal plate by a photomechanical process commonly practiced in the photoengraving art or by other standard means. The image consistss of areas where the metal is protected by a photo-resist coating, and nonimage areas where bare metallic surfaces are exposed. These bare metallic areas are etched to a sufficient depth to permit a printing process to take place or for the preparation of mats. Typical depths are in the range of from about 0.004 inch (e.g. for halftones) to about 0.040 inch for newspaper work and up to 0.150 inch for flexographic masters.

A plate having both the image (resist protected) and non-image (bare metal) areas is placed in a commercial etcher for etching. Various types of etchers are used, these all being of such character that droplets of an etching liquid are directed against the surface of the plate to be etched, preferably in such fashion that a large part of the droplets impinge on the plate in a direction having a substantial component perpendicular to said surface of the plate. Typical etching machines include those in which the droplets are formed and flung by paddles which successively dip into an etching bath and then are raised above it, turning about a horizontal axis; those in which the etching liquid is sprayed out of nozzles; and those in which streams of the etching liquid which break up into droplets are jetted from orifices in a revolving hollow shaft. Etchers of the foregoing type are shown, by way of example, in U.S. Pat. Nos. 2,669,048, 3,402,083 and 3,689,333.

Conventional magnesium etching liquids have as the primary etching agent a strong inorganic acid such as nitric acid, sulfuric acid or hydrochloric acid, nitric acid currently being the etching agent of choice. However, the action of such a strong acid on the exposed bare metal areas is omnidirectional, although the desired direction of etch is perpendicular to the surface to be etched and preferably is such that the sidewall (shoulder) beneath the non-etched (imaged) portion slopes (banks), preferably steeply, toward the etched area so as to strengthen the support for the imaged area; this is particularly desirable where the imaged area is small as, for example, in halftone, fine line and closed letter geometries. The omnidirectional etching action of strong inorganic acids results in lateral etching which undercuts and weakens the imaged areas and which even undercuts the protective resist so as to reduce and, on occasion, obliterate imaged areas.

To prevent this and to obtain a desired angle of bank, it has been the practice to include various additives in etching liquids, these including strong inorganic acid etching liquids for magnesium. In other words, it is the function of these additives to limit the direction of etching to the perpendicular or slightly off perpendicular (in favor of wider bases for the imaged areas) and thereby prevent lateral etching. Thus, sidewalls that form around the imaged areas are contiguous with the image, creating both the line and the halftone imaged areas which large constitute a composite magnesium printing or pattern plate.

One of the conventional components of a commercial filming agent (a filming agent is a mixture of water-immiscible liquids, surfactants and coupling agents which is added to an aqueous etching agent to obtain a suitable angle of bank; "coupling agent" is a term which denotes a material having a solubilizing and/or dispersing effect and which specifically will render water-soluble and/or water-dispersible a bath additive that is not so normally characterized) is a water-immiscible hydrocarbon liquid, examples of which are gasoline, benzine, kerosene, turpentine, diethylbenzenes, coal oil and lubricating oils. Another conventional component is an anionic surface-active agent, e.g. a sulfonated surfactant, or a mixture of such agents. Still another component is a coupling agent or a mixture of coupling agents.

The filming agents which have been used conventionally, of late, in baths that etch magnesium in order to produce letter-press and pattern plates do not employ water-immiscible hydrocarbon liquids, except occasionally to a minor extent. Such conventional filming agents for magnesium eliminate the water-immiscible hydrocarbon liquids and, instead, employ fatty monocarboxylic acids that are in liquid form in the bath. These fatty monocarboxylic acids contain from 6 to 26 carbon atoms, are saturated or unsaturated, are unsubstituted or substituted with alkyl, aryl and/or alkylaryl groups, and have straight or branched chains. Such fatty monocarboxylic acids have been observed to control the etching depth of non-imaged areas alongside fine lines and halftones and to prevent undercutting of the imaged areas in these critically important portions of magnesium plates.

More recently, organic polycarboxylic acids such as dicarboxylic and tricarboxylic acids, examples of which are adipic, malic and citric acids (see U.S. Letters Pat. Nos. 3,053,719 and 3,152,083) have been used as a component of filming agents for magnesium etching liquids. These were considered essential to obtain a better quality of etching in a nitric acid etching liquid for magnesium; but they were susceptible to oxidative degradation brought about by the nitric acid etchant. The degradation was not rapid but, in practice, as an etching liquid was used over a period of time, the degradation caused the performance of the etching liquid to deteriorate gradually. It was necessary for operators to detect such degradation before the results of etching became unsatisfactory and plates had to be discarded. When the degradation was observed the operator added to the nitric acid etching liquid other surfactants or components which counteracted the undesirable activity imparted by the degradation products of the polycarboxylic acids. To operate with such polycarboxylic acids entailed a certain amount of operator judgment, experience and skill.

The degradation even occurred when a nitric acid etching liquid containing polycarboxylic acids stood idle for several hours as, for example, over night, or for a few days such as over a weekend or holidays. Here, too, the degradation products of the polycarboxylic acids deteriorated the etching liquid and, as a matter of practice, frequently caused the liquid to be useless because of lowering of the protective action of the filming agent when the etching process was started up after a period of inactivity.

Another problem which has plagued the art in this field is that where water-immiscible hydrocarbon liquids were used in conjunction with sulfonated surfactants as the protective components of a filming agent, rather large amounts of the blends of these compounds had to be employed. This was rather expensive; moreover, the bulk of the filming agent led to high shipping and storage costs.

It also has been observed that the emulsified blends of water-immiscible hydrocarbon liquids and surfactants which produced a semi-stable emulsion that formed a protective film on the areas to be etched adjacent the lateral edges, fine lines, lines defining closed letter areas and delicate halftones tended to soften cured photo-resists that had been formed and which were supposed to protect the imaged areas against attack by the etching agent. Sometimes the softening was so extreme that the photo-resist stripped from the metal surface of the magnesium plate during etching and, obviously, where this occurred, the integrity of the image was destroyed.

There has been a further problem that applies with particular force to so-called "combination" plates which in the art are referred to as having "mixed geometries", these being plates with different types of configurations to be etched thereon such as halftones, line work, conventional printing, bold type and reverse printing which generally are characterized by the removal of considerably different amounts of metal per unit area.

It has been observed with current etching baths that the slopes of the sidewalls vary with the extent of metal removed in a unit area. Thus, where the amount of metal removed was small, the slopes of the sidewalls were steep [tight] and, conversely, when the amount of metal removed was large, the slopes of the sidewalls were less steep [broad]. The slope of the sidewall is generally known as a "shoulder angle", this being the angle between the sidewall and an imaginary line perpendicular to the original surface of the plate. Investigation has shown that in modern etching systems the sidewalls in zones where small amounts of metal are being removed are cooler than the sidewalls where large amounts of metal are being removed, due, it is believed, to the fact that where a small amount of metal is being removed the heat produced by etching is less than where a large amount of metal is being removed. Rough measurements in different areas indicate plate temperatures in the range of 100°–200°F. where a small amount of metal is being removed, and plate temperatures in the range of 200°–400°F. where a large amount of metal is being removed. Higher plate temperatures appear to have two different effects. One is a faster rate of etching. The second is an enhancement of the protective action of the protective film on the sidewalls.

As a practical matter, this has created difficulties. One has been that it is generally desirable to have a substantially uniform shoulder angle for the entire plate, and this has not been possible with combination plates because where the plate was hot the enhanced protection of the sidewall film broadened the shoulder angle. Conversely, in a cooler area with a weaker film the shoulder angle tightened or even undercut. Therefore, the practice has been to group plates according to the geometries of the overall photoresist patterns so that the shoulder angles could be held relatively constant and adjustments were made in bath temperatures, concentrations and paddle speeds to obtain a desired plate temperature and, hence, a desired angle for a given type of photoresist pattern.

On the other hand, where it has not been feasible to separate combination plates into groups, if a desired shoulder angle is obtained for one portion of the plate there may be undercutting at another portion of the plate, and if the shoulder angle is proper, say, for a cool area of the plate, the shoulder angle may be too broad for a hotter area of the plate.

SUMMARY OF THE INVENTION

1. Purposes of the Invention

It is the principal object of the invention to provide a novel filming agent, etching liquid and method of etching magnesium plates which eliminate the foregoing drawbacks.

It is another object of the invention to provide a filming agent, etching liquid and method of the character described which secure good banking angles even with fine lines, halftones and closed letter areas, but without employing polycarboxylic acids which, as noted above, are susceptible to degradation when used with a strong inorganic etching acid.

It is another object of the invention to provide a filming agent, etching liquid and method of the character described which eliminate the need for water-immiscible hydrocarbon liquids of any type in a filming agent, etching liquid and method, and thus do away with the disadvantages consequent upon the use thereof such, for instance, as the softening and stripping of photo-resist coatings and the necessity for incorporating large amounts of such hydrocarbon liquids and the consequent large amount of surfactants that conventionally are used therewith.

It is another object of the invention to provide a filming agent, etching liquid and method of the character described which creates a more uniform shoulder angle in plates of widely varying geometries.

It is another object of the invention to provide a filming agent, etching liquid and method of the character described which enables an unskilled operator to use a standardized etching bath under standardized conditions for use with photoresist patterns of varying geometries.

It is another object of the invention to provide a filming agent, etching liquid and method of the character described which makes the etching bath and the use thereof largely insensitive to the geometries of different plates to be etched.

It is another object of the invention to provide a filming agent, etching liquid and method of the character described which obtains a more uniform average of shoulder angles at all areas of plates being etched, and particularly of combination plates.

It is another object of the invention to provide a filming agent, etching liquid and method of the character described which enable etching to be carried out at higher than present-day conventional temperatures and, therefore, shorten the time required to etch to a desired depth without broadening shoulder angles to an unacceptable extent.

It is another object of the invention to provide a filming agent, etching liquid and method of the character described which can be utilized in existing apparatuses and without requiring the development of fresh skills or knowledge on the part of operators and which, indeed, will simplify the operator's work and thus will enable him to attend to larger or additional etching machines so as to increase his production.

It is another object of the invention to provide a filming agent, etching liquid and method of the character described which operate efficiently, which are able to make etched magnesium plates of high quality and which, withal, are no more costly than those presently employed.

Other objects of the invention in part will be obvious and in part will be pointed out hereinafter.

2. Brief Description of the Invention

A primary aspect of the present invention resides in dispensing with the use of polycarboxylic acids, thereby eliminating the disadvantages inherent therein and, in their place, using organophosphonic acids which improve the chemical stability of the etching system because they are not subject to oxidative degradation or any other type of degradation in a strong inorganic acid etching liquid. Filming agents including organophosphonic acids inter alia provide superior protective characteristics in the etching of a printing plate.

Moreover, the present invention employs in the additive and etching bath fatty monocarboxylic acids in liquid form, essentially to the exclusion of water-immiscible hydrocarbon liquids which monocarboxylic acids, in combination with the organophosphonic acids and in a strong inorganic acid etching liquid, produce a highly synergistic and protective action against undesirable etching and do this with a lesser volume of additives per unit volume of etching liquid than heretofore. In addition, utilization of the fatty monocarboxylic acids has the further advantage of avoiding the undesirable softening and/or stripping of the photo-resist coating that attends the use of water-immiscible hydrocarbon liquids. The employment of the fatty monocarboxylic acids permits the complete elimination of water-immiscible hydrocarbon liquids from the filming agent and etching liquid, although it is within the scope of the invention to employ a small amount of water-immiscible hydrocarbon liquids if desired. The monocarboxylic acid constituent must be liquid in the etching bath.

The fatty monocarboxylic acids useful in the present invention are selected from a wide variety of such acids providing that the carbon atoms present lie within the range of 6 to 26. Such acids can be saturated or unsaturated; they can be unsubstituted or substituted with alkyl, aryl and/or alkylaryl groups; they can be straight or branched chain. Monocarboxylic acids which are suitable for use in the present invention are described by K. S. Markley in "Fatty Acids", Interscience, 1947, pages 20–43. The saturated and unsaturated fatty monocarboxylic acids with 18 carbon atoms are of particular interest because of their present commercial availability. The preferred fatty monocarboxylic acid is isostearic acid. A commercial source of supply for the same is Emery Industries, Inc. of Cincinnati, Ohio.

In connection with the primary aspect of the invention, a required ingredient of the additive and etching bath is an alkyl aryl sulfonate such as dodecylbenzene sulfonic acid, dinonylnaphthalene sulfonic acid, nonylnaphthalene sulfonic acid and octylbenzene sulfonic acid.

The organophosphonic acids used in accordance with the primary aspect of the present invention are selected from the group consisting of organic phosphonic acids having two phosphonic acid groups attached to the same carbon atom and aminomethylene phosphonic acids in which at least one of the nitrogen atoms has at least one methylene phosphonic acid group attached thereto. The presence of such organophosphonic acids results in a substantial improvement in the performance of a strong inorganic acid etching bath including the new filming agent.

The filming agent of the primary aspect of the present invention may include, in addition to a fatty monocarboxylic acid, an alkyl aryl sulfonic acid and an organophosphonic acid, one or more surfactants and/or coupling agents. Preferred coupling agents are butyl Carbitol (diethylene glycol monobutyl ether) and hexyl Cellosolve (ethylene glycol monohexyl ether). Preferred surfactants are tertiaryoctylphenoxypolyoxyethyl ethanol and nonylphenoxypolyoxyethyl ethanol. Other surfactants which can be used in the practice of the invention to provide good filming agents and etching liquids are the various alkali earth metal, ammonium and amine salts of sulfated and/or sulfonated fatty monocarboxylic acids, for example, oleic acid, stearic acid, caprylic acid, myristic acid, palmitic acid, and ricinoleic acid and hydrolyzable esters thereof.

It further has been discovered that in the filming agent of the primary aspect of the present invention, which is characterized by the presence of an organophosphonic acid, an alkyl aryl sulfonate and a fatty monocarboxylic acid, a certain desirable result can be obtained by including in the filming agent an amine selected from the group consisting of branched, unbranched, saturated and unsaturated primary, secondary and tertiary acyclic amines and alicyclic amines, having at least 6 carbon atoms. Materials from this group impart to an etching bath containing the same the ability of the etching reagent to form shoulders of approximately the same shoulder angle in different portions of combination plates which, as will be recalled, are plates having printing portions adjacent etched areas from which substantially different amounts of metal are removed by etching. Amines of the aforesaid group can be incorporated in the filming agent and/or in the bath directly in any one of various ways. One way is to supply the amine(s) to the etching bath as a compound separate from the additive. Another way is to incorporate the amines in the filming agent additive as amine moieties of amine salts of any one or more of (1) the organophosphonic acid, (2) the fatty monocarboxylic acid, or (3) the alkyl aryl sulfonic acid. An additional way is to incorporate the amines in the filming agent additive as moieties of salts the anions of which are obtained from strong inorganic acids such, for instance, as nitric, sulfuric or hydrochloric acid. The amines are present in the etching liquid (bath) as hydrolyzable salts of the strong inorganic etching acid.

It will be realized that adding the aforesaid amines as moieties of the salts of the sundry acids mentioned above neutralizes as much of the acids as that of which salts are formed. It usually is not desirable to fully neutralize the acids with these amines. However, it is desirable to neutralize not only the remainder of these acids but other acid constituents of the filming agent prior to their addition to the aqueous etching reagent. Such additional neutralization desirably is accomplished by adding an alkalizing agent such as alkali earth metal hydroxides, ammonium hydroxide and water-soluble amines. The amount of alkalizing agent present desirably is such that the pH of the filming agent is alkaline, e.g. 8.0 to 10.0, whereby the filming agent as manufactured and sold to the trade is a clear homogenous liquid.

The filming agent also includes water.

When the filming agent is added to a water-diluted inoroganic etching acid to form a working bath, the amines of the aforesaid group and the neutralizing agent are transformed to salts of said acid.

There is a particular precaution to be exercised when the amines of said group are employed in the filming agent and, as amine salts, in the bath, which is that when such amines are present neither a sulfonated nor a sulfated fatty monocarboxylic (C 6-26) acid or salt thereof should be used inasmuch as the concurrent presence of such amines and such acids interferes with the etching action.

Another aspect of the present invention relates to the novel function of the amines of the aforesaid group with respect to their mentioned ability to improve the overall shoulder angle uniformity of plates etched with a strong inorganic acid. Said amines have been observed to function in etching baths of the general character above described merely by virtue of their presence and not necessarily by the incorporation of every one of the components of the baths with which the primary aspect of the invention is concerned. Specifically, such amines have been observed to obtain the desired uniformity of shoulder angle in the absence of organophosphonic acids and in the absence of sulfated or sulfonated fatty monocarboxylic acids, the organophosphonic acids not necessrily having to be omitted but the sulfated or sulfonated fatty monocarboxylic acids necessarily being absent (in the primary aspect of the invention as well) in order for the amines to achieve their desired result.

BRIEF DESCRIPTION OF THE DRAWINGS

In the accompanying drawings in which are shown operational results of different formulations embodying the invention.

DESCRIPTION OF THE PREFERRED EMBODIMENTS

Figure 1:
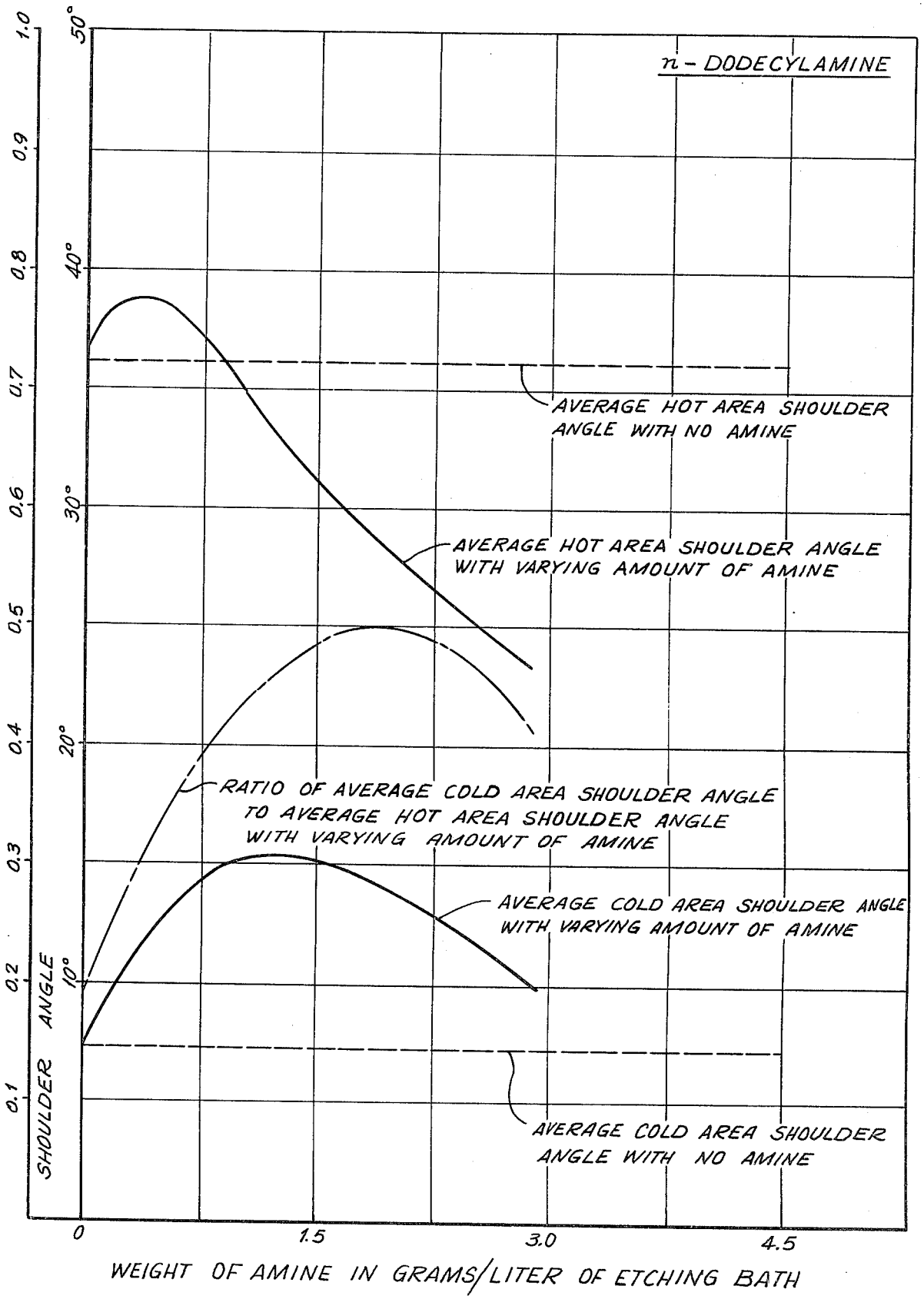
FIGS. 1 – 4 are graphs illustrating shoulder angles for hot and cold areas of etched magnesium plates, with and without different ones of the aforesaid group of acyclic and alicyclic amines and with different amounts of such amines, and of the ratios of the shoulder angles using these amines, FIG. 1 illustrating the graphs for n-dodecylamine in a certain bath embodying other constituents pursuant to the present invention, FIG. 2 illustrating the graphs for n-nonylamine in a bath otherwise having the same constituents, FIG. 3 illustrating the graphs for secondary octylamine in such bath, and FIG. 4 illustrating the graphs for 2-ethyl hexylamine.
Figure 2:
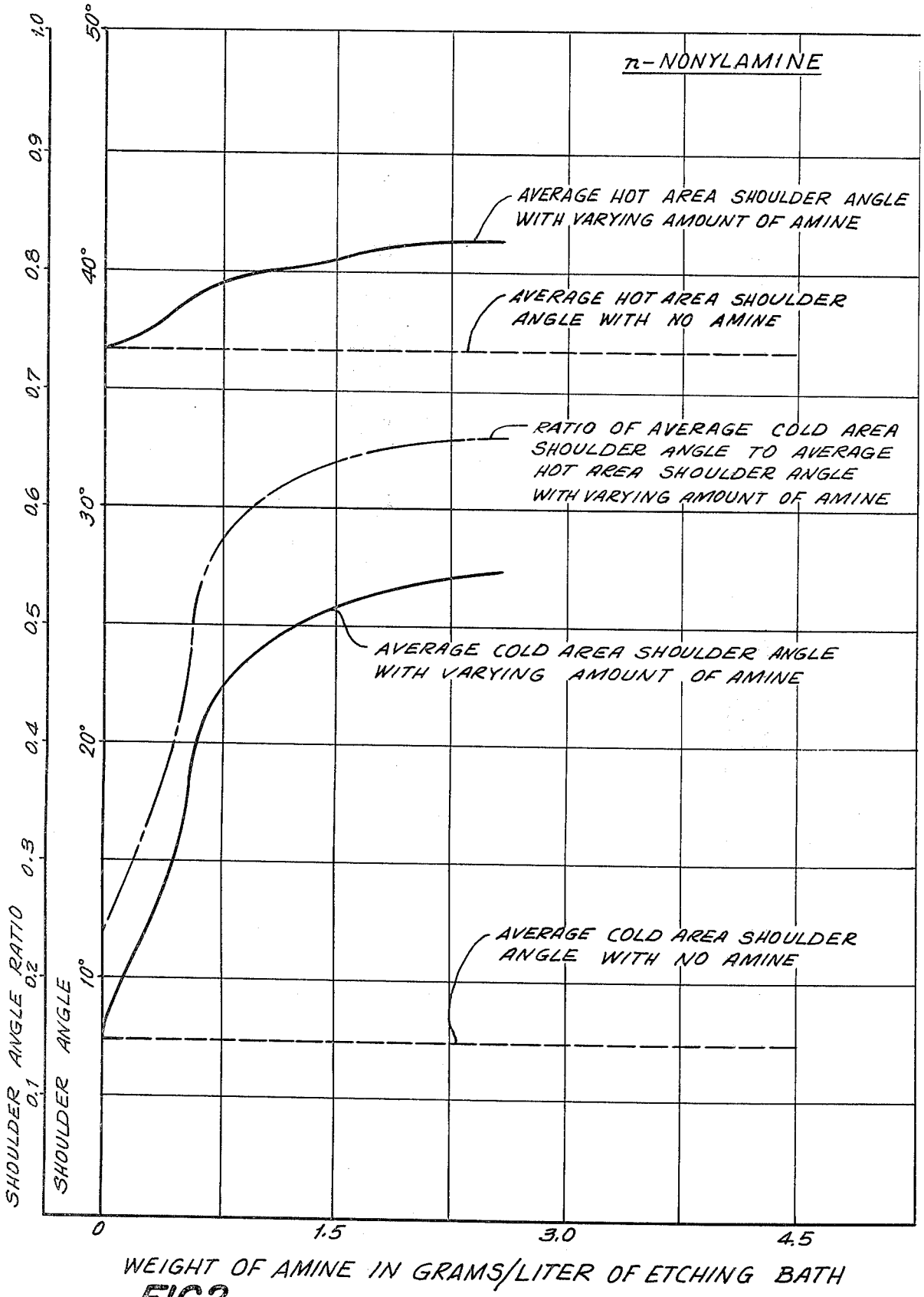
Figure 3:
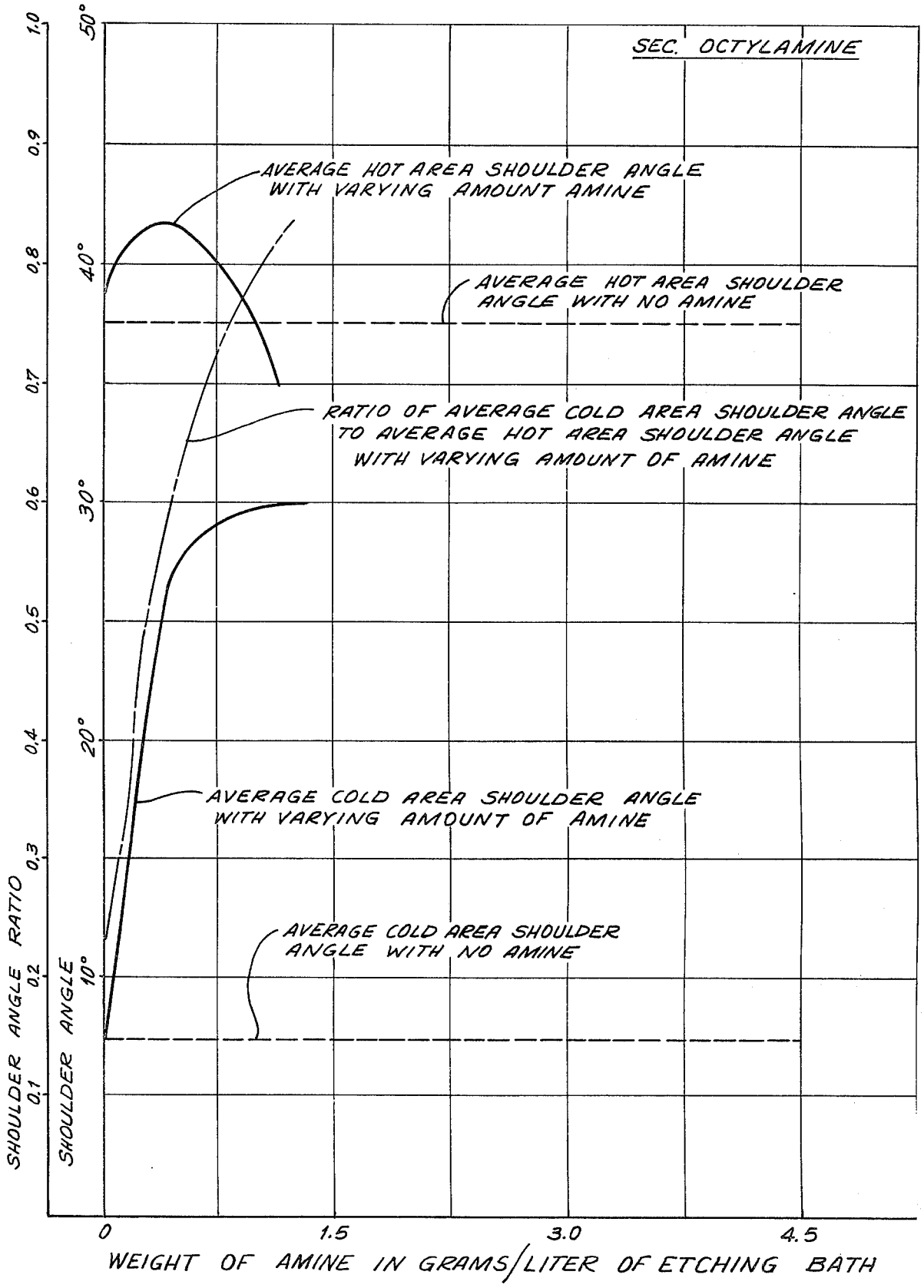
Figure 4:
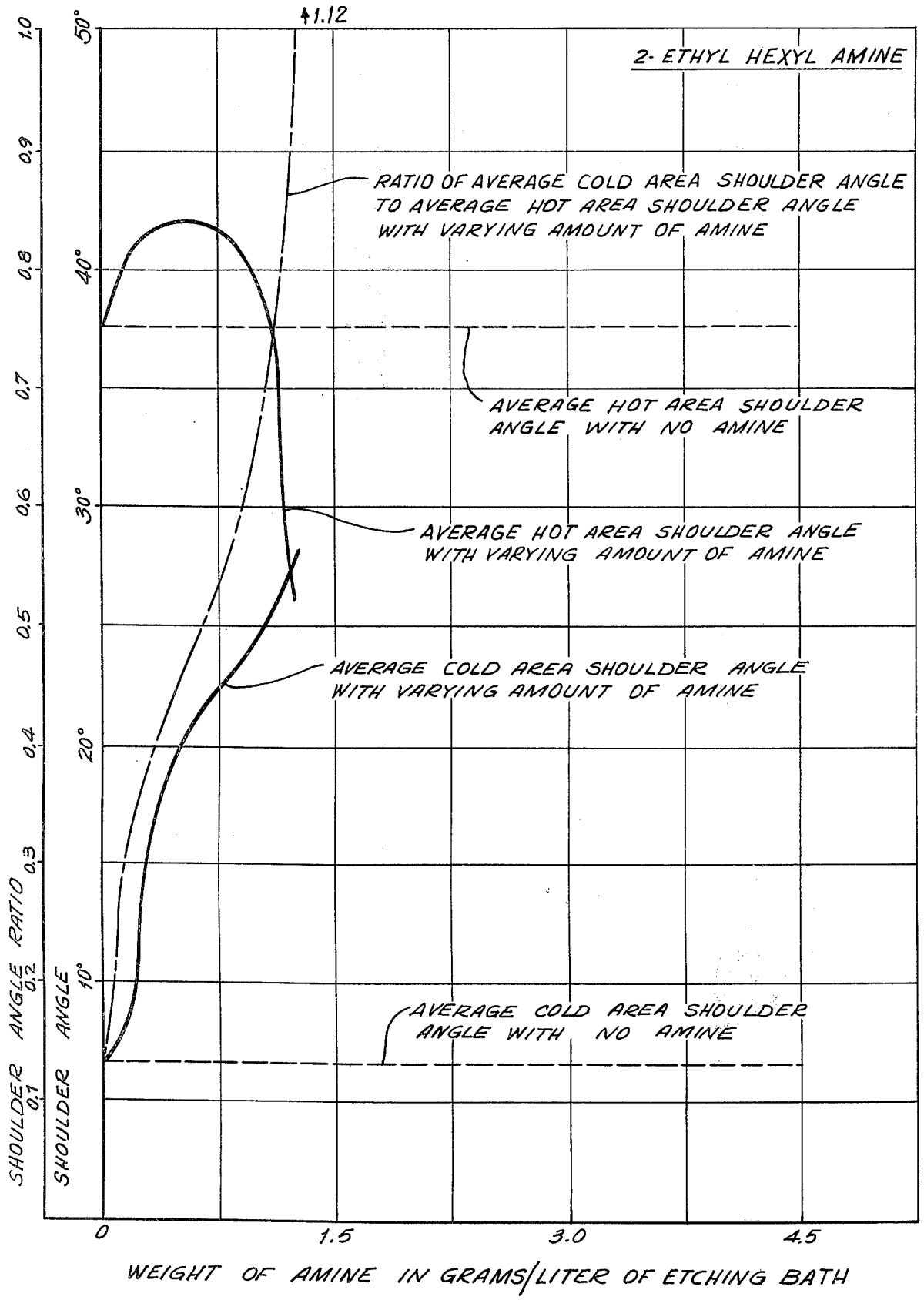

The basic components of an etching liquid incorporating the primary aspect of the present invention are eight. These constitute: (1) from 10% to 30% by volume of an etching liquid (working bath) of a strong inorganic acid, e.g. a concentrated 42° Be. aqueous nitric acid solution, (2) from 1 to 25 grams per liter of the etching liquid of a fatty monocarboxylic acid in liquid form containing from 6 to 26 carbon atoms, said acid being substantially non-reactive with the strong inorganic acid employed, being saturated or unsaturated, unsubstituted or substituted with alkyl, aryl and/or alkylaryl groups, and having straight or branched chains, (3) from 1 to 10 grams per liter of the etching liquid of an organophosphonic acid, (4) from 1 to 10 grams per liter of the etching liquid of an alkyl aryl sulfonic acid or a salt thereof, (5) from 3 to 40 grams per liter of the etching liquid of a blend of surfactants and/or coupling agents, and (6) water to make up the remainder. Optional additional ingredients are (7) a neutralizing agent to raise the pH of the additive to from 8.0 to 10.0, and (8) when present, from 0.1 to 10 grams per liter [this weight range is for the amine moiety of the amine salt] of the etching liquid of a salt of a branched, unbranched, saturated or unsaturated primary, secondary or teritary acyclic amine or an alicyclic amine, having at least 6 carbon atoms [compound (8) may be combined chemically with compounds (2), (3) and (4) in the filming agent]. It will be appreciated, of course, that if the etching liquid and bath include a sulfated or sulfonated fatty monocarboxylic acid (C 6–26), no amine such as just mentioned should be present, and vice versa. Other adjuvants well known in the powderless etching art, such as very small amounts of aliphatic and/or aromatic hydrocarbon liquids may be incorporated in the etching liquid to act as foam suppressants. Components (2), (3), (4), (5) and (7), and optionally (8), with some water make up the filming agent of the present aspect of the invention which is added to a strong inorganic acid and more water to form the etching liquid. The amine can be present in the filming agent as such or as a salt, in any event converting to a salt of the strong inorganic acid upon addition to the working bath.

Typical ranges for preferred components of a filming agent to be used in an etching liquid embodying the primary aspect of the present invention are set forth below:

| Components | Ranges Per Liter of Etching Liquid |
|---|---|
| Polyhydric alcohols &/or ethers thereof (coupling agent is a minimal function) | 0–30 g. |
| Non-ionic polyethoxylate | 0–20 g. |
| Sulfated or sulfonated monocarboxylic acids or salts or esters thereof | 3–40 g. |
| | 0–10 g. |
| | (surfactants) |
| Alkyl aryl sulfonates or salts thereof | 1–10 g. |
| Fatty monocarboxylic acids | 1–25 g. |
| Organic phosphonic acids | 1–10 g. |

-continued

| Components | Ranges Per Liter of Etching Liquid |
|---|---|
| Water-insoluble amine salt (when present) | 0.1–10 g.[for amine moiety] |
| Alkalizing agent to adjust pH to from 8.0 to 10.0 | |
| Water | q.s. to about 50 ml. |

The aforementioned coupling agents and surfactants are, as indicated, only preferred. It is within the ambit of the present invention to use some or all of these coupling agents and surfactants or to substitute other coupling agents and surfactants well known in the art of metal etching for some or all of the aforesaid specific coupling agents and surfactants.

The strong inorganic acids [see (1) above] are: nitric, sulfuric and hydrochloric acids.

As to the fatty monocarboxylic acid [see (2) above], one or more of the same are employed in the filming agent. There is a large group of available fatty monocarboxylic acids which are useful in carrying out the invention. By way of example, typical useful monocarboxylic acids are those described by K. S. Markley in "Fatty Acids," Interscience, 1947, pages 20–43.

The organophosphonic acid [see (3) above] (one or more can be employed) is an acid selected from the group consisting of organophosphonic acids having at least two phosphonic acid groups attached to the same carbon atom and aminoethylenephosphonic acids in which at least one of the nitrogen atoms has at least one methylene phosphonic group attached thereto.

By way of example, commercially available organophosphonic acids included in the aforesaid group are:

1. methylene diphosphonic acid

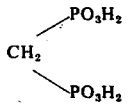

2. 1-hydroxyethane 1,1-diphosphonic acid

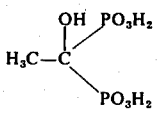

3. nitrilo tris(methylene phosphonic acid)

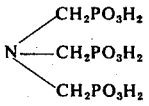

4. N-carboxymethyl,N,N-di(methylene phosphonic acid)

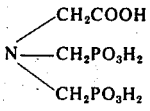

5. hexamethylenediamine tetra(methylene phosphonic acid)

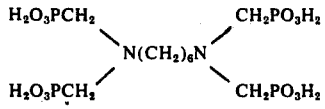

6. ethylenediamine tetra(methylene phosphonic acid)

$$(H_2O_3PCH_2)_2N(CH_2)_2N(CH_2PO_3H_2)_2$$

7. diethylenetriamine penta(methylene phosphonic acid)

$$(H_2O_3PCH_2)_2NCH_2-CH_2N(CH_2PO_3H_2)-CH_2N(CH_2PO_3H_2)_2$$

8. N,N-di(carboxymethyl) N-methylene phosphonic acid

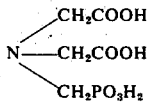

9 N-(2-hydroxyethyl) N,N-di-(methylene phosphonic acid)

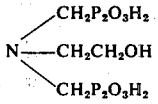

10. N-hydroxymethyl,N,N′,N′-ethylene diamine tris(methylene phosphonic acid)

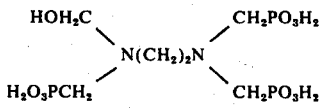

11. N-hydroxyethyl,N,N′,N′-ethylene diamine tris(-methylene phosphonic acid)

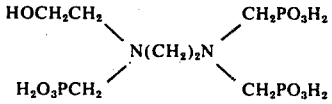

12. 2-hydroxypropylene diamine N,N′,N,N′-tetra (methylene phosphonic acid)

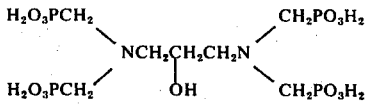

13. di(2-hydroxypropylene) triamine penta(methylene phosphonic acid)

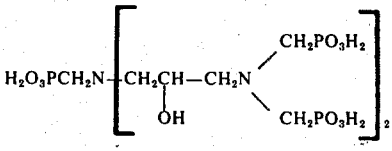

14. tri(2-hydroxypropylene) tetraamine hexa-(methylene phosphonic acid)

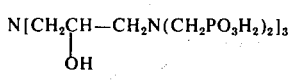

The organophosphonic acids identified as (3) above presently are preferred in the practice of the invention. Such acids and their water-soluble salts are available from Monsanto Chemical Company of St. Louis, Missouri, as DEQUESTs and from Wayland Chemical Division, Lincoln, Rhode Island, of Philip A. Hunt Chemical Corp. as WAYPLEXs. Particularly, chemical (2) as a Monsanto product is known as DEQUEST 2010 and as a Wayland product as WAYPLEX HEDPA 60.

The alkylaryl sulfonic acids [component (4)] presently preferred have from 6 to 18 carbon atoms in the alkyl portion and from 6 to 10 carbon atoms in the aryl portion. Commercially available acids of this nature include: dodecylbenzene sulfonic acid and dinonylnaphthalene sulfonic acid. The alkali earth metal, ammonium and amine salts of the alkylaryl sulfonates may be employed.

The surfactants and coupling agents [component (5)] are those conventional in the etching art and include, by way of example, ethers of polyhydric alcohols as well as polyhydric alcohols, e.g. methyl Carbitol, butyl and hexyl Carbitol, butyl and hexyl Cellosolve, propylene glycol, diethylene glycol, glycerine, 1,2,6 hexanetriol; sulfated and sulfonated monocarboxylic fatty acids and esters thereof, e.g. $\alpha$-sulfopalmitic acid, sulfophenylstearic acid, sulfonated oleic acid, $\alpha$-sulfostearic acid, sulfated ricinoleic acid, sulfated castor oil, sulfated butyl palmitate, sulfonated amyl oleate and alkali earth metal, ammonium and amine salts thereof; non-ionic polyethoxylated surfactants, e.g. tertiaryoctylphenoxypolyoxyethyl ethanol, nonylphenoxypolyoxyethyl ethanol and octylphenoxypolyoxyethyl ethanol.

Suitable neutralizing agents [component (7)] to be used in the filming agent prior to its addition to the aqueous solution of strong inorganic acid in order to impart homogeneity to the filming agent by raising the pH thereof to from about 8.0 to about 10.0 and thereby solubilize otherwise waterinsoluble or not highly water-soluble components, are alkali earth metal hydroxides and ammonium hydroxide. In passing, it may be mentioned that amines also could be used for neutralizing agents but the amounts necessary become commercially unfeasible. Therefore, amine moieties, when present, usually are employed in one or more of the basic components of an etching liquid incorporating the primary aspect of the present invention only for some of the specific organic acids.

The amines [component (8)] used in an etching bath pursuant to the present invention in order to obtain the desirable type of shoulder formation discussed hereinabove are primary, secondary and tertiary branched, unbranched, saturated and unsaturated acyclic amines and alicyclic amines, having at least 6 carbon atoms. By way of example, such amines may be selected from the following: primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine. The amines are present in the inorganic acid working bath as salts of the anion of said inorganic acid.

Other adjuvants may be incorporated in the filming agent if desired, a typical one being an aliphatic and/or aromatic liquid hydrocarbon which, if used, should only be present in minor amounts rather than in major amounts, so as not to encourage any tendency of the etching liquid to soften or strip the etch-resist image coating from the surface of the magnesium plate during etching.

The basic components of an etching liquid embodying the second aspect of the present invention are:

1. as above, including amount, with respect to the primary aspect of the invention,

2. as above, including amount, in the same respect,

3. the organophosphonic acid may be partially or entirely replaced by a polycarboxylic acid having from 2 to 10 carbon atoms [the preferred range for this component, i.e. the polycarboxylic acid, is from 1 to 10 grams per liter of etching bath],

4. as above, including amount,

5. as above, including amount,

6. as above, including amount,

7. as above, including amount,

8. as above, including amount, but necessary, and

9. no sulfonated or sulfated fatty monocarboxylic acids (C 6 – 26).

It is not necessary to detail any of the components except the polycarboxylic acids having from 2 to 10 carbon atoms inasmuch as these components have been specified in connection with the primary aspect of the present invention. Insofar as the polycarboxylic acid is concerned, it is characterized by the fact, as noted just previously, that it has from 2 to 10 carbon atoms. Typical examples of such acids are: citric acid, malic acid, adipic acid, maleic acid, succinic acid and azelaic acid. The alkali earth metal salts, ammonium salts, amine salts and hydrolyzable esters of these acids can be used in place of such acids.

As mentioned previously, the new filming agent and new etching liquid of both aspects of the invention have several advantages over previously employed filming agents and etching liquids used in conjunction with the etching of magnesium plates. These advantages include increased stability of the new filming agent, increased stability of the new etching liquid, that is to say, the ability of such an etching liquid to stand idle for hours and days without deteriorating (losing the protective capability of the filming agent), the non-softening and non-stripping characteristic of the new etching liquid on etchresist coatings, the reduced bulk and weight of the new filming agent; the higher etching capability of the new etching liquid (the ability of a given volume of the new etching liquid containing the new filming agent to etch more square inches of a magnesium plate than prior art etching liquids containing the same amount and concentration of nitric acid but employing other filming agents), the excellent protective action of the new etching liquid containing the new filming agent against undesirable lateral etching, good regulation of the depth of etch in printing patterns involving small circumscribed areas and small image areas such as dots and fine lines, and good uniformity of shoulder angle.

A further advantage of the new filming agent of both aspects of the invention and the new etching liquid containing the same is the ability to employ the filming agent with widely varying amounts of aqueous strong inorganic acids in the etching liquid whereby the same type of new filming agent can be utilized in strong, rapid etching liquids as well as in weaker, slower etching liquids, different speeds being desirable to secure different qualities for a given printing plate.

Several examples of filming agents and etching liquids embodying both aspects of the present invention have been set forth below. In all instances the filming agents are to be added to nitric acid and diluted with water to form an etching liquid. The etching liquid then is used in accordance with conventional manipulative steps in the art of etching magnesium plates, that is to say, the etching liquid can constitute a bath in a splash or paddle-type etcher, or an etching liquid in a spray etcher, or an etching liquid in a revolving jet etcher. Typical etching equipments are shown, by way of example, in U.S. Pat. Nos. 2,669,048; 3,402,083 and 3,689,333. Exemplificatively, where splash or paddle etching is practiced, typical operating conditions for the etching bath are a bath temperature of 90°–120° F. with a preferred temperature of 100°–105° F., a paddle speed with a 6-inch paddle of 450 to 650 rpm with a preferred speed of 560 to 600 rpm, and with an 8-inch paddle a speed of 300 to 400 rpm with a preferred speed of 340 to 360 rpm. The paddle dip is about ¼ inch to about ½ inch with a preferred dip of ⅜ inch. The ratio of the volume of the filming agent to the volume of the etching bath is about 1:10 to 1:50, the preferred ratio being 1:15 to 1:30.

In all the etching methods performed with the different types of equipment mentioned, the etching liquid is formed into droplets which are propelled against the surface of a plate to be etched (suitably protected by a patterned etch-resist) in a direction having a component substantially perpendicular to said surface.

The following example lists preferred components and their preferred ranges for an etching bath embodying the primary aspect of the present invention.

EXAMPLE I

| Components | g/l of Etching Bath |
|---|---|
| Aqueous nitric acid, 42° Be.(etching agent) | 160 – 320 |
| Hexyl Cellosolve (coupling agent) | 2 – 3 |
| Butyl Carbitol (coupling agent) | 2 – 6 |
| Isostearic acid (monocarboxylic acid) | 4 – 8 |
| Caprylic acid (monocarboxylic acid) | 1 – 3 |
| Organic polyphosphonic acid | 1 – 5 |
| Alkylaryl sulfonate | 2 – 5 |
| Sulfonated oleic acid | 1 – 3 |
| Tertiaryoctylphenoxy-polyoxyethyl ethanol (surfactant) | 1 – 3 |
| Water | q.s. to 1 liter |

It will be observed that the above example is for an etching liquid which includes the etching agent, the water diluent and components which are attributable to the filming agent. The filming agent, per se, includes all of the above components except the etching agent and some of the water diluent. The filming agent also includes an alkalizing agent such as potassium hydroxide the presence of which will be mentioned in the next table which is directed to the filming agent, per se. The alkalizing agent is neutralized by the massive quantity of nitric acid in the bath.

The following is an example of an etching liquid embodying the primary aspect of the present invention and, by way of comparison, other etching liquids, one of which uses a dicarboxylic acid and the other a tricarboxylic acid instead of an organic polyphosphonic acid. In a subsequent table, the different etching liquids will be evaluated as to their stabilities, this being their etching abilities after standing idle.

EXAMPLE II

| Components | g/l of Etching Bath | | |
|---|---|---|---|
| | Formula I | Formula II | Formula III |
| Nitric acid, 42°Be. (etching agent) | 170 | 170 | 170 |
| Hexyl Cellosolve (coupling agent) | 2.7 | 2.0 | 2.2 |
| Butyl Carbitol (coupling agent) | 4.5 | 4.5 | 4.5 |
| Isostearic acid (monocarboxylic acid) | 5.5 | 5.1 | 5.1 |
| Caprylic acid (monocarboxylic acid) | 1.7 | 0.6 | 0.6 |
| Triethanolamine salt of sulfonated oleic acid (surfactant) | 2.2 | 2.1 | 2.1 |
| Isopropylamine salt of dodecylbenzene sulfonic acid (alkylaryl sulfonate) | 2.7 | 2.4 | 2.4 |
| Tertiary octyl phenol [Ethoxylated with 7 mols of ethylene oxide] (surfactant) | 1.8 | 1.7 | 1.7 |
| Malic acid (dicarboxylic acid) | — | 1.7 | — |
| Citric acid (tricarboxylic acid) | 1.4 | — | — |
| 1-hydroxyethane 1,1-diphosphonic acid (organic phosphonic acid) | — | — | 3.3 |
| Water | balance to make up 1 liter | balance to make up 1 liter | balance to make up 1 liter |

It will be observed that Formula I of EXAMPLE II is an etching liquid formula which contains a polycarboxylic acid (specifically a tricarboxylic acid) in combination with fatty monocarboxylaic acids. Formula II substitues a dicarboxylic acid for the tricarboxylic acid and Formula III substitutes an organophosphonic acid of the present invention for the polycarboxylic acids; the remaining components of the three formulas are the same and the quantitative amounts thereof are approximately the same having been adjusted for approximately the same etching activity when the etching liquid is freshly prepared.

EXAMPLES I and II describe etching liquids, these being liquids in which the etching agent is nitric acid and in which filming agents have been added together with enough water to make up one liter.

In TABLE A which follows, there are set forth the components of the three different filming agents which are used to make up the three etching liquids of EXAMPLE II. These filming agents have been formulated for use in an etching liquid containing 12% of 42° Be. nitric acid and 5% filming agent.

TABLE A

| Components | Filming Agent Formulas g/l of Filming Agent | | |
|---|---|---|---|
| | Formula I | Formula II | Formula III |
| Water | 475 | 537 | 537 |
| Potassium hydroxide (90%) | 76 | 58 | 58 |
| Butyl Carbitol | 101 | 101 | 101 |
| Isostearic acid | 122 | 113 | 113 |
| Caprylic acid | 39 | 14 | 14 |
| Hexyl Cellosolve | 61 | 45 | 50 |

TABLE A-continued

| Components | Filming Agent Formulas g/l of Filming Agent Formula I | Formula II | Formula III |
|---|---|---|---|
| Triethanolamine salt of sulfonated oleic acid | 49 | 46 | 46 |
| Isopropylamine salt of dodecylbenzene sulfonic acid | 61 | 54 | 54 |
| Tertiary octyl phenol (ethoxylated with 7 mols of ethylene oxide) | 41 | 39 | 39 |
| Malic acid | — | 38 | — |
| Citric acid | 32 | — | — |
| 1-hydroxyethane 1,1-diphosphonic acid | — | — | 73 |

The three etching liquids of EXAMPLE II, one of which constitutes an etching liquid of the present invention and the others etching liquids that substitute for an organic phosphonic acid, polycarboxylic acids of the prior art have substantially different stabilities, this being one of the major contributions of the primary aspect of the present invention. Stability may be measured by a degree of change in halftone depth when the etching liquid is allowed to stand idle for a fixed period of time. The period of time selected for comparison is 18 hours. In evaluating the results which are given below, it is useful to note as a reference that commonly acceptable halftone depths of etch for newspaper type work (conventionally using 55 to 65 line screen with about 10% highlights — a typical figure used for this nature of comparison) range from about 4.6 to about 8.0 thousandths of an inch. Any deeper etch is unacceptable because it degrades the quality of the image as reproduced on newsprint.

Table of Comparative Etches of Formulas of EXAMPLE II

| Etching Liquid Formula | Depth of Halftone Etching Using a Fresh Etching Bath | Depth of Halftone Etching After Etching Bath is Permitted to Stand Idle for 18 Hours | Percentage of Change in Etch Depth |
|---|---|---|---|
| I | 0.0075" | 0.0160" | 113% |
| II | 0.0075" | 0.0120" | 60% |
| III | 0.0075" | 0.0090" | 20% |

The following is an example of an etching liquid embodying the primary aspect of the invention which is characterized in that it employs a short straight chain saturated fatty monocarboxylic acid to the exclusion of any other fatty monocarboxylic acid:

EXAMPLE III

| Components | g/l of Etching Bath |
|---|---|
| Nitric acid, 42° Be. | 170.251 |
| Caprylic acid | 5.376 |
| Butyl Carbitol | 5.376 |
| Nitrilo tris(methylene phosphonic acid) | 2.240 |
| Hexyl Cellosolve | 4.480 |
| Triethanolamine salt of sulfonated oleic acid | 5.376 |
| Isopropylamine salt of dodecylbenzene sulfonic acid | 4.928 |
| Nonylphenoxypolyoxyethyl ethanol | 4.032 |
| Water | q.s. to 1 liter |

The following is an example of another etching liquid embodying the primary aspect of the present invention which is characterized in that it employs a short branched chain saturated fatty monocarboxylic acid to the exclusion of any other fatty monocarboxylic acid.

EXAMPLE IV

| Components | g/l of Etching Bath |
|---|---|
| Nitric acid, 42° Be. | 169.489 |
| Nitrilo tris(methylene phosphonic acid) | 2.240 |
| 2-ethyl hexanoic acid | 6.720 |
| Triethanolamine salt of sulfonated oleic acid | 1.344 |
| Isopropylamine salt of dodecylbenzene sulfonic acid | 2.688 |
| Water | q.s. to 1 liter |

The following is an example of a further etching liquid embodying the primary aspect of the present invention which is characterized in that it employs a long chain unsaturated fatty monocarboxylic acid to the exclusion of any other fatty monocarboxylic acid.

EXAMPLE V

| Components | g/l of Etching Bath |
|---|---|
| Nitric acid, 42° Be. | 284.6 |
| Butyl Carbitol | 2.554 |
| 1-hydroxyethane 1,1-diphosphonic acid | 4.032 |
| Oleic acid | 10.976 |
| Hexyl Cellosolve | 2.329 |
| Triethanolamine salt of sulfonated oleic acid | 2.509 |
| Isopropylamine salt of dodecylbenzene sulfonic acid | 3.226 |
| Nonylphenoxypolyoxyethyl ethanol | 2.061 |
| Water | q.s. to 1 liter |

The foregoing example is an illustration of an etching liquid using a high concentration of nitric acid, to wit, 20% by volume of 42° Be. rather than 12% as in previous examples; hence, it will etch at a faster rate.

The following is an example of another etching liquid embodying the primary aspect of the present invention which is characterized in that it employs a long straight chain saturated fatty monocarboxylic acid to the exclusion of any other fatty monocarboxylic acid.

EXAMPLE VI

| Components | g/l of Etching Bath |
|---|---|
| Nitric acid, 42° Be. | 170.000 |
| Nitrilo tris(methylene phosphonic acid) | 5.600 |
| n-stearic acid | 4.480 |
| Triethanolamine salt of sulfonated oleic acid | 5.825 |

-continued

| EXAMPLE VI | |
|---|---|
| Components | g/l of Etching Bath |
| Isopropylamine salt of dodecylbenzene sulfonic acid | 3.584 |
| Butyl Carbitol | 2.240 |
| Hexyl Cellosolve | 2.240 |
| Water | q.s. to 1 liter |

The following is an example of another etching liquid embodying the primary aspect of the present invention which is characterized in that it employs a long branched chain saturated fatty monocarboxylic acid and a short chain saturated fatty monocarboxylic acid.

| EXAMPLE VII | |
|---|---|
| Component | g/l of Etching Bath |
| Nitric acid, 42° Be. | 170.000 |
| Butyl Carbitol | 5.316 |
| Isostearic acid | 5.947 |
| Caprylic acid | 1.579 |
| Hexyl Cellosolve | 2.632 |
| 1-hydroxyethane 1,1-diphosphonic acid | 4.184 |
| Triethanolamine salt of sulfonated oleic acid | 2.421 |
| Isopropylamine salt of dodecylbenzene sulfonic acid | 2.842 |
| Nonylphenoxypolyoxyethyl ethanol | 1.921 |
| Water | q.s. to 1 liter |

The following is an example of another etching liquid embodying the primary aspect of the invention which is characterized in that it employs a medium length straight chain saturated fatty monocarboxylic acid to the exclusion of any other fatty monocarboxylic acid.

| EXAMPLE VIII | |
|---|---|
| Components | g/l of Etching Bath |
| Nitric acid, 42° Be. | 170.000 |
| Butyl Carbitol | 4.480 |
| Nitrilo tris(methylene phosphonic acid) | 2.240 |
| Myristic acid | 5.824 |
| Hexyl Cellosolve | 3.360 |
| Triethanolamine salt of sulfonated oleic acid | 4.928 |
| Isopropylamine salt of dodecylbenzene sulfonic acid | 2.688 |
| Nonylphenoxypolyoxyethyl ethanol | 1.747 |
| Water | q.s. to 1 liter |

The following is an example of another etching liquid embodying the primary aspect of the present invention which is characterized in that it employs a mixture of fatty monocarboxylic acids, one short chain and the other long chain, and in that the concentration of nitric acid employed is high, i.e. 20%, such as in EXAMPLE V.

| EXAMPLE IX | |
|---|---|
| Components | g/l of Etching Bath |
| Nitric acid. 42° Be. | 282.36 |
| Butyl Carbitol | 2.552 |
| Isostearic acid | 6.132 |
| Caprylic acid | 2.632 |
| Hexyl Cellosolve | 2.316 |
| 1-hydroxyethane 1,1-diphosphonic acid | 3.013 |
| Triethanolamine salts of sulfonated oleic acid | 2.500 |
| Isopropylamine salt of dodecylbenzene sulfonic acid | 2.947 |
| Nonylphenoxypolyoxyethyl ethanol | 2.158 |
| Water | q.s. to 1 liter |

The following is an example of another etching liquid embodying the primary aspect of the present invention which is characterized in that it employs a substituted fatty monocarboxylic acid to the exclusion of any other fatty monocarboxylic acid.

| EXAMPLE X | |
|---|---|
| Components | g/l of Etching Bath |
| Nitric acid, 42° Be. | 170.000 |
| Nitrilo tris(methylene phosphonic acid) | 1.792 |
| Butyl Carbitol | 2.016 |
| Hexyl Cellosolve | 2.016 |
| Phenyl stearic acid | 2.240 |
| Triethanolamine salt of sulfonated oleic acid | 3.808 |
| Isopropylamine salt of dodecylbenzene sulfonic acid | 3.500 |
| Water | q.s. to 1 liter |

The following is an example of another etching liquid embodying the primary aspect of the invention which is characterized by the omission of a sulfonated or a sulfated fatty monocarboxylic acid.

| EXAMPLE XI | |
|---|---|
| Components | g/l of Etching Bath |
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| N,N-di(carboxymethyl) N-methylene phosphonic acid | 3.14 |
| Water | q.s. to 1 liter |

The following are two examples of etching liquids embodying the primary aspect of the present invention which are characterized by the substitution of a sulfated fatty monocarboxylic acid or ester for sulfonated fatty monocarboxylic acids.

EXAMPLE XII

| Components | g/l of Etching Bath |
|---|---|
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| N,N-di(carboxymethyl) N-methylene phosphonic acid | 3.14 |
| Sulfated castor oil | 0.60 |
| Water | q.s. to 1 liter |

EXAMPLE XIII

| Components | g/l of Etching Bath |
|---|---|
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| N,N-di(carboxymethyl) N-methylene phosphonic acid | 3.14 |
| Sulfated ricinoleic acid | 0.70 |
| Water | q.s. to 1 liter |

All the magnesium printing plates etched with the foregoing liquids were of excellent quality.

The following are examples of the second aspect of the present invention, these being etching baths that are characterized by the presence of the components of the primary aspect of the invention except that there are no sulfated or sulfonated fatty monocarboxylic acids and by the inclusion of a salt of an acyclic or alicyclic amine having at least 6 carbon atoms, it being observed that this phase of the invention functions satisfactorily if some or all of the organophosphonic acid is replaced by a polycarboxylic acid having from 2 to 10 carbon atoms. In this example and subsequent examples showing the use of amine salts pursuant to this invention, only the weight of the amine moiety is given since it is simpler to include such moiety as a component of the filming agent, the same being converted to the salt upon the addition to diluted nitric acid.

EXAMPLE XIV

| Components | g/l of Etching Bath |
|---|---|
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| Cyclohexyl amine | 0.90 |
| N-hydroxymethyl,N,N',N'- | |

-continued

EXAMPLE XIV

| Components | g/l of Etching Bath |
|---|---|
| ethylene diamine tris (methylene phosphonic acid) | 2.09 |
| Water | q.s. to 1 liter |

EXAMPLE XV

| Components | g/l of Etching Bath |
|---|---|
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| Tri(n-propyl) amine | 0.90 |
| N,N-di(carboxymethyl) N-methylene phosphonic acid | 3.14 |
| Water | q.s. to 1 liter |

EXAMPLE XVI

| Components | g/l of Etching Bath |
|---|---|
| Nitric acid, 42° Be. | 281.60 |
| Butyl Carbitol | 4.16 |
| White mineral oil | 0.69 |
| Caprylic acid | 1.97 |
| Isostearic acid | 4.76 |
| Isopropylamine salt of dodecylbenzene sulfonic acid | 2.65 |
| Tertiary octylphenoxy ethanol | 2.58 |
| 2-hydroxypropylene diamine N,N',N,N'-tetra(methylene phosphonic acid) | 3.14 |
| Dicyclohexyl amine | 1.12 |
| Water | q.s. to 1 liter |

EXAMPLE XVII

| Components | g/l of Etching Bath |
|---|---|
| Nitric acid, 42° Be. | 281.60 |
| Butyl Carbitol | 4.16 |
| White mineral oil | 0.69 |
| Caprylic acid | 2.20 |
| Isostearic acid | 4.32 |
| Isopropylamine salt of dodecylbenzene sulfonic acid | 2.66 |
| Tertiary octylphenoxy polyethoxyethyl ethanol | 2.58 |
| Di-n-hexyl amine | 0.45 |
| N-carboxymethyl,N,N-di (methylene phosphonic acid) | 3.14 |
| Water | q.s. to 1 liter |

Combination magnesium printing plates etched with EXAMPLES XIV – XVII likewise were of excellent quality and, additionally, had good uniformity of shoulder angles in hot and cold areas of the plates.

The following formulations are two examples in which amines as above described are used and which are characterized by the substitution of a polycarboxylic acid (C 2 to 10), actually citric acid, for the organophosphonic acids:

EXAMPLE XVIII

| Components | g/l of Etching Bath |
|---|---|
| Nitric acid, 42° Be. | 197.00 |
| Citric acid | 2.52 |
| Butyl Carbitol | 2.24 |
| White mineral oil | 1.34 |
| Caprylic acid | 2.85 |
| Isostearic acid. 4.48 | |
| Nonylphenoxypolyoxyethyl ethanol | 4.32 |
| Dodecylbenzene sulfonic acid | 2.78 |
| n-octyl amine | 0.33 |
| Water | q.s. to 1 liter |

EXAMPLE XIX

| Components | g/l of Etching Bath |
|---|---|
| Nitric acid, 42° Be. | 310.00 |
| Citric acid | 2.71 |
| White mineral oil | 1.77 |
| Nonylphenoxypolyoxyethyl ethanol | 5.40 |
| Caprylic acid | 3.07 |
| Isostearic acid | 5.31 |
| Dodecylbenzene sulfonic acid | 2.90 |
| Secondary octyl amine | 0.59 |
| Water | q.s. to 1 liter |

The foregoing etching liquids form etching magnesium plates, combination or otherwise, of unusually good characteristics. Such plates have very uniform shoulder angles over the entire areas of the plates; they can be etched quite rapidly at high temperatures without deleteriously affecting any of the desired qualities of an etched plate such as uniform shoulder angle, smoothness of shoulder, absence of dirt and pimples, and etch factors exceeding 100. The temperatures and rates at which the bath can operate are as great as 140° F. and 0.018 inch a minute. Great etching depths are easily obtainable with such liquids using polycarboxylic acids and amines of the character described, e.g. 0.20 inch, which heretofore has not been feasible due to limitation of time and deterioration of etching qualities. Previously, depths of such nature required the use of machine tools.

The following formulation is an example in which amines as above described are used and which is characterized by the substitution of a polycarboxylic acid (C 2 – 10), actually malic acid, which is substituted for a portion of the organophosphonic acid.

EXAMPLE XX

| Components | g/l of Etching Bath |
|---|---|
| Nitric acid, 42° Be. | 282.36 |
| Butyl Carbitol | 2.552 |
| Isostearic acid | 6.132 |
| Caprylic acid | 2.632 |
| Hexyl Cellosolve | 2.316 |
| 1-hydroxyethane 1,1-diphosphonic acid | 1.500 |
| Malic acid | 1.550 |
| Isopropylamine salt of dodecylbenzene sulfonic acid | 2.947 |
| Nonylphenoxypolyoxyethyl ethanol | 2.158 |
| n-hexadecyl amine | 1.200 |
| Water | q.s. to 1 liter |

The following formulation (called EXAMPLE XXI) is one embodying the primary aspect of the present invention but omitting amine salts that characterize the second aspect of the invention and which desirably are included therein. This example is used in conjunction with various amounts of salts of the following amines: n-dodecyl amine, n-nonyl amine, secondary octyl amine and 2-ethyl hexyl amine. All the just-mentioned salts of amines are those within the group of amines prescribed for use in connecction with the instant invention. This formulation was employed to etch combination plates which normally, that is to say, in the absence of such amines, would have non-uniform shoulder angles in hot and cold areas. In FIGS. 1 – 4 graphs have been illustrated which show the action of the aforesaid bath with and without the aforesaid amines, in hot and cold areas. These graphs also illustrate the ratio of the shoulder angles for the hot and cold areas as the amounts of the amine salts vary. Again, for convenience, the weights of the amine salts have been given as weights of the amine moieties of the salts.

EXAMPLE XXI

| Components | g/l of Etching Bath |
|---|---|
| Nitric acid, 42° Be. | 280.00 |
| Butyl Carbitol | 4.74 |
| White mineral oil | 0.79 |
| Caprylic acid | 2.50 |
| Isostearic acid | 4.92 |
| Hydroxyethane diphosphonic acid | 3.70 |
| Isopropylamine salt of dodecylbenzene sulfonic acid | 3.03 |
| Nonylphenoxypolyoxyethyl ethanol | 2.94 |
| Water | q.s. to 1 liter |

Figure 5:
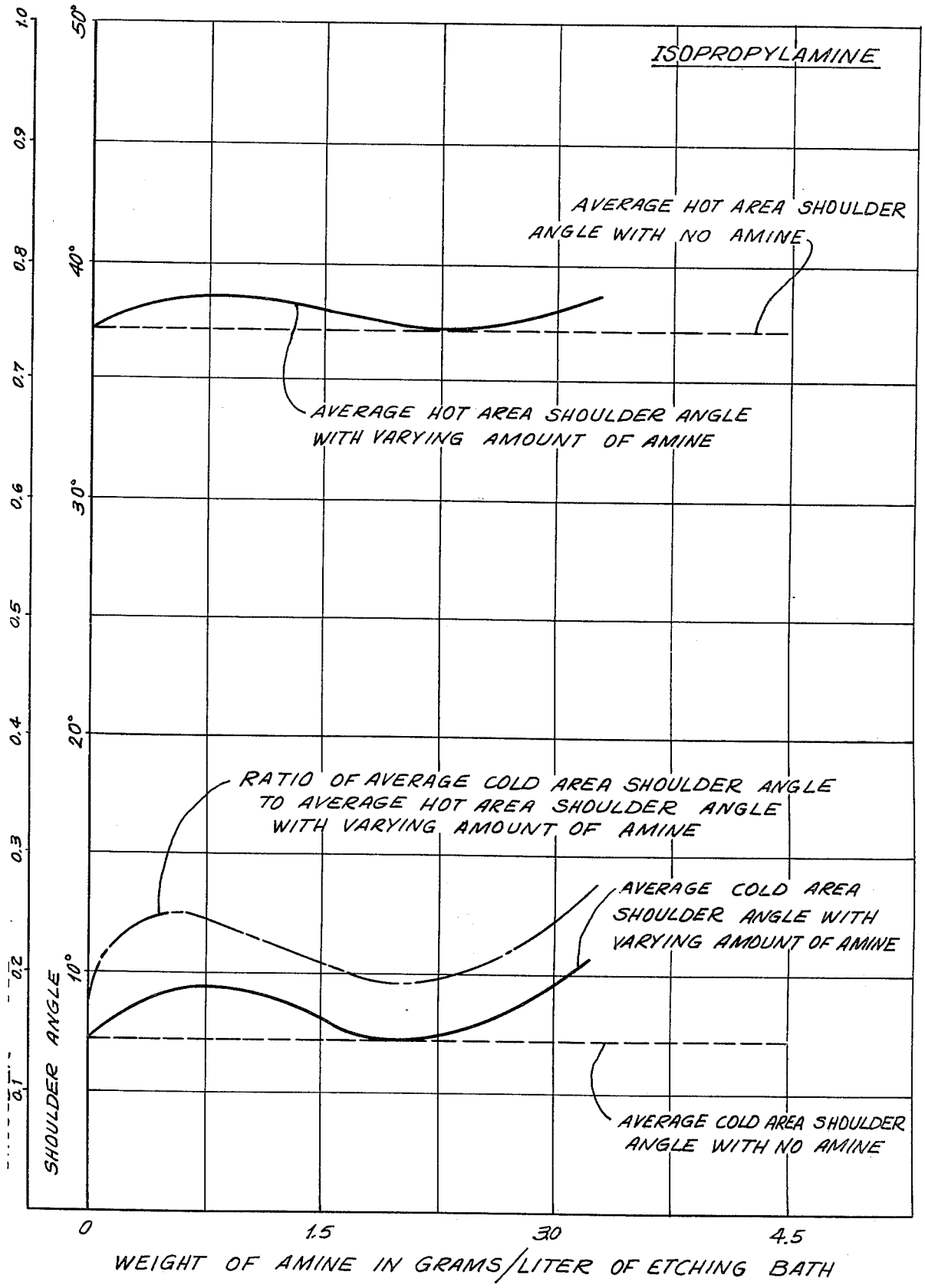
FIGS. 5 and 6 are graphs similar to FIGS. 1 – 4 but illustrating similar graphs for the same baths including amines that do not function in accordance with the present invention, the amine of FIG. 5 being isopropylamine and the amine of FIG. 6 being triethanolamine.
Figure 6:
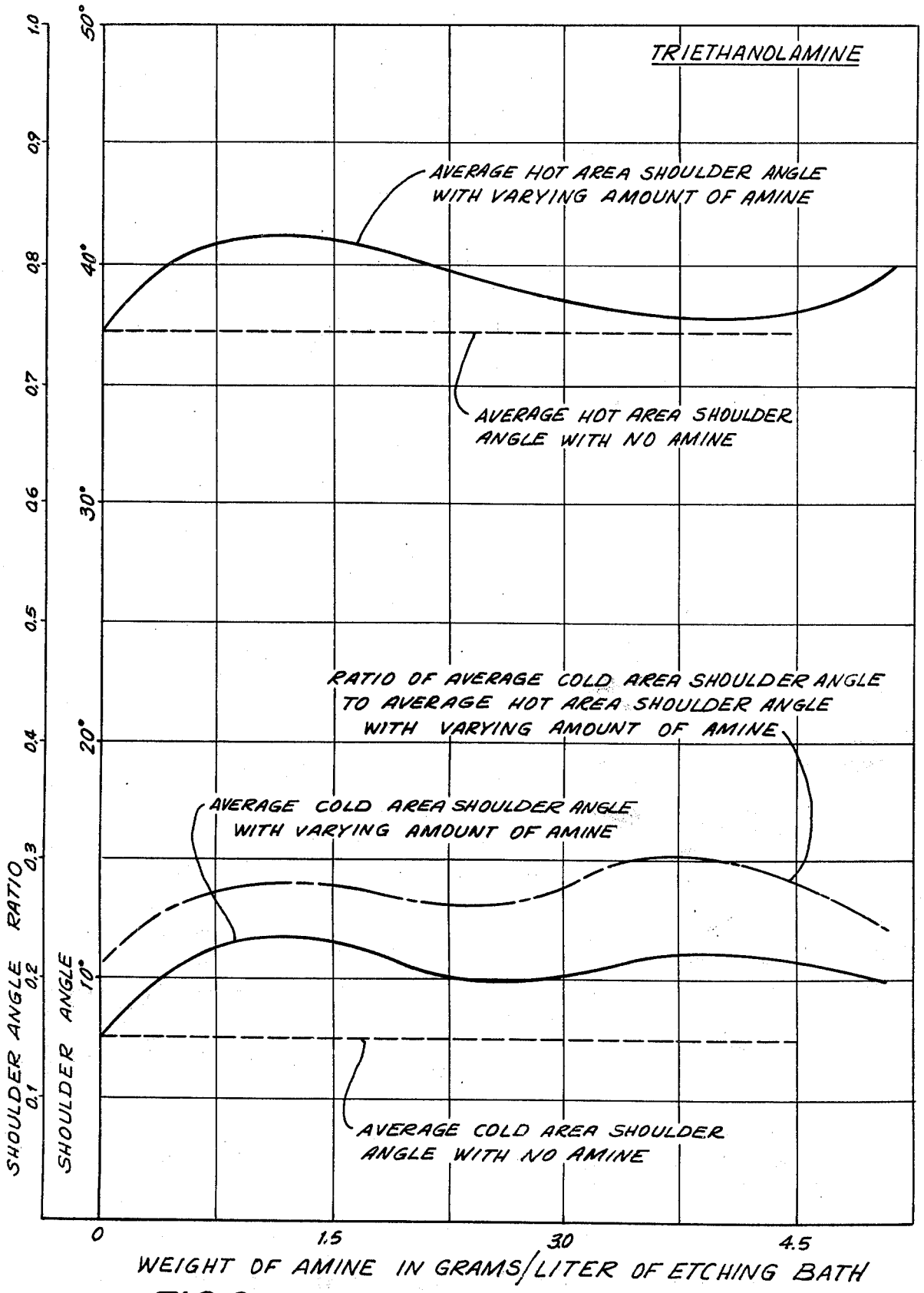

In order to illustrate the effect of adding salts of amines not within the aforesaid group, FIGS. 5 and 6 have been included which illustrate the change in shoulder angles in hot and cold areas and shoulder angle ratios in the hot and cold areas of plates treated with the bath of EXAMPLE XXI to which there have been added varying amounts of salts of isopropylamine and triethanolamine, respectively, the weights being given as those of the amine moieties.

Combination magnesium plates etched with EXAMPLE XXI but including salts of amines that do not conform to the description of amine salts pursuant to the present invention showed no marked improvement in the ratio of uniformity of shoulder angles in the hot and cold areas of the plates as the amounts of the amine salts varied, it being noted that isopropylamine has less than 6 carbon atoms and that triethanolamine is not an acyclic amine because it has had a hydroxyl group substituted thereon so that it is not aliphatic.

It will be observed that all examples in which a salt of an amine of the mentioned group is included with nitric acid, a fatty monocarboxylic acid (C 6–26), an alkyl aryl sulfonic acid or salt, a blend of surfactants and water, neither a sulfated nor a sulfonated fatty monocarboxylic acid (C 6–26) is employed and, indeed, as previously noted, such sulfated or sulfonated acids should be omitted when the aforesaid amine salts are present in order to secure suitable etching. It has been observed that even as little as 0.5 grams per liter of such a sulfated or sulfonated fatty acid (C 6–26) makes a plate unusable when such an additive is employed. Hence, the amount of such an acid that can be used best is described as being essentially absent, that is to say, so little that only a trace amount can be tolerated.

It thus will be seen that there are provided a filming agent, an etching liquid and an etching method for etching an imaged magnesium plate which achieve the various objects of the invention and which are well adapted to meet the conditions of practical use.

As various possible improvements might be made in the above invention and as various changes might be made in the embodiments above set forth, it is to be understood that all matter herein described is to be interpreted as illustrative and not in a limiting sense.

Having thus described the invention, there is claimed as new and desired to be secured by Letters Patent:

1. An etching liquid for etching bare areas of a magnesium plate, other portions of which are covered with an etch-resist pattern, said etching liquid including I. a strong inorganic acid,
II. at least one liquid fatty monocarboxylic acid having from 6 to 26 carbon atoms and substantially non-reactive with the inorganic acid,
III. at least one organophosphonic acid,
IV. at least one alkylaryl sulfonic acid,
V. at least one surfactant or coupling agent, and
VI. water.

2. An etching liquid as set forth in claim 1 wherein the strong inorganic acid is nitric acid.

3. An etching liquid as set forth in claim 2 wherein the components are present in the following ranges per liter of etching liquid: (I) from 10% to 30% by volume of a 42° Be. aqueous solution; (II) from 1 to 25 grams; (III) from 1 to 10 grams; (IV) from 1 to 10 grams; (V) from 3 to 40 grams; and (VI) balance.

4. An etching liquid as set forth in claim 1 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

5. An etching liquid as set forth in claim 3 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

6. An etching liquid as set forth in claim 5 wherein the organophosphonic acids are selected from the group consisting of:

methylene diphosphonic acid;
1-hydroxyethane 1,1-diphosphonic acid;
nitrilo tris(methylene phosphonic acid);
N-carboxymethyl,N,N-di(methylene phosphonic acid);
hexamethylenediamine tetra(methylene phosphonic acid);
ethylenediamine tetra(methylene phosphonic acid);
diethylenetriamine penta(methylene phosphonic acid);
N,N-di(carboxymethyl) N-methylene phosphonic acid;
N-(2-hydroxyethyl) N,N-di-(methylene phosphonic acid);
N-hydroxymethyl,N,N',N'-ethylene diamine tris(methylene phosphonic acid);
N-hydroxyethyl,N,N',N'-ethylene diamine tris(methylene phosphonic acid);
2-hydroxypropylene diamine N,N',N,N'-tetra(methylene phosphonic acid);
di(2-hydroxypropylene)triamine penta(methylene phosphonic acid); and
tri(2-hydroxypropylene) tetraamine hexa(methylene phosphonic acid).

7. An etching liquid as set forth in claim 1 wherein the alkylaryl sulfonic acid is selected from the group consisting of dodecylbenzene sulfonic acid and dinonylnaphthalene sulfonic acid.

8. An etching liquid as set forth in claim 1 wherein the surfactants and coupling agents are selected from the group consisting of:

propylene glycol;
diethylene glycol;
glycerine;
1,2,6 hexanetriol;
diethylene glycol methyl ether
diethylene glycol monobutyl ether
diethylene glycol monohexyl ether
ethylene glycol monobutyl ether
ethylene glycol monohexyl ether
α-sulfopalmitic acid;
sulfophenylstearic acid;
sulfonated oleic acid;
α-sulfostearic acid;
sulfonated amyl oleate;
sulfated ricinoleic acid;
sulfated castor oil;
sulfated butyl palmitate;
tertiary octylphenoxypolyoxyethyl ethanol;
nonylphenoxypolyoxyethyl ethanol; and
octylphenoxypolyoxyethyl ethanol.

9. An etching liquid as set forth in claim 3 which further includes at least one sulfonated fatty monocarboxylic acid with from 6 to 26 carbon atoms.

10. An etching liquid as set forth in claim 3 which further includes at least one sulfated fatty monocarboxylic acid with from 6 to 26 carbon atoms.

11. An etching liquid as set forth in claim 2 which further includes at least one salt of an acyclic or alicyclic amine having at least 6 carbon atoms, there being essentially absent from the etching liquid sulfonates and sulfates of fatty monocarboxylic acids.

12. An etching liquid as set forth in claim 3 which further includes at least one salt of an acyclic or alicyclic amine having at least 6 carbon atoms, there being essentially absent from the etching liquid sulfonates and sulfates of fatty monocarboxylic acids.

13. An etching liquid as set forth in claim 12 wherein the amine moiety of the amine salt is selected from the group consisting of primary, secondary and tertiary branched, unbranched, saturated and unsaturated amines and saturated cyclic amines.

14. An etching liquid as set forth in claim 13 wherein the amine moiety of the amine salt is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

15. An etching liquid as set forth in claim 13 wherein the amine moiety of the amine salt is present in an amount of from 0.1 to 10 grams per liter of etching liquid.

16. An etching liquid as set forth in claim 12 wherein the organophosphonic acid is selected from the group consisting of organic phosphonic acids having two phosphonic acid groups attached to the same carbon atom and aminomethylene-phosphonic acid in which at least one of the nitrogen atoms has at least one methylene phosphonic acid group attached thereto.

17. An etching liquid for etching bare areas of a magnesium plate, other portions of which are covered with an etch-resist pattern, said etching liquid including I. a strong inorganic acid, II. at least one liquid fatty monocarboxylic acid having from 6 to 26 carbon atoms and substantially nonreactive with the inorganic acid, III. at least one polycarboxylic acid having from 2 to 10 carbon atoms, IV. at least one alkylaryl sulfonic acid, V. at least one surfactant or coupling agent, VI. at least one salt of an acyclic or an alicyclic amine having at least 6 carbon atoms, and there being essentially absent from the etching liquid sulfonates and sulfates of fatty monocarboxylic acids, and VIII. water.

18. An etching liquid as set forth in claim 17 wherein the strong inorganic acid is nitric acid.

19. An etching liquid as set forth in claim 18 wherein the components are present in the following ranges per liter of etching liquid: (I) from 10% to 30% by volume of a 42° Be. aqueous solution; (II) from 1 to 25 grams; (III) from 1 to 10 grams; (IV) from 1 to 10 grams; (V) from 3 to 40 grams; (VI) from 0.1 to 10 grams; and (VII) balance.

20. An etching liquid as set forth in claim 19 wherein the amine moiety of the amine salt is selected from the group consisting of primary, secondary and tertiary branched, unbranched, saturated and unsaturated amines and saturated cyclic amines.

21. An etching liquid as set forth in claim 20 wherein the amine moiety of the amine salt is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

22. An etching liquid as set forth in claim 20 wherein the amine moiety of the amine salt is present in an amount of from 0.1 to 10 grams per liter of etching liquid.

23. An etching liquid as set forth in claim 20 wherein the polycarboxylic acid is selected from the group consisting of citric acid, malic acid, adipic acid, maleic acid, succinic acid, and azelaic acid.

24. An etching liquid for etching bare areas of a magnesium plate, other portions of which are covered with an etch-resist pattern, said etching liquid including I. a strong inorganic acid, II. at least one liquid fatty monocarboxylic acid having from 6 to 26 carbon atoms and substantially nonreactive with the inorganic acid, III. at least one polycarboxylic acid having from 2 to 10 carbon atoms and at least one organophosphonic acid, IV. at least one alkylaryl sulfonic acid, V. at least one surfactant or coupling agent, VI. at least one salt of an acyclic or an alicyclic amine having at least 6 carbon atoms, and there being essentially absent from the etching liquid sulfonates and sulfates of fatty monocarboxylic acids, and VII. water.

25. An etching liquid as set forth in claim 24 wherein the strong inorganic acid is nitric acid.

26. An etching liquid as set forth in claim 25 wherein the components are present in the following ranges per liter of etching liquid: (I) from 10% to 30% by volume of a 42° Be. aqueous solution; (II) from 1 to 25 grams; (III) from 1 to 10 grams; (IV) from 1 to 10 grams; (V) from 3 to 40 grams; (VI) from 0.1 to 10 grams; and (VII) balance.

27. An etching liquid as set forth in claim 24 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

28. An etching liquid as set forth in claim 26 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

29. An etching liquid as set forth in claim 28 wherein the organophosphonic acids are selected from the group consisting of:

methylene diphosphonic acid;
1-hydroxyethane 1,1-diphosphonic acid;
nitrilo tris(methylene phosphonic acid);
N-carboxymethyl,N,N-di(methylene phosphonic acid);
hexamethylenediamine tetra(methylene phosphonic acid);
ethylenediamine tetra(methylene phosphonic acid);
diethylenetriamine penta(methylene phosphonic acid);
N,N-di(carboxymethyl) N-methylene phosphonic acid;
N-(2-hydroxyethyl) N,N-di-(methylene phosphonic acid);
N-hydroxymethyl,N,N',N'-ethylene diamine tris(-methylene phosphonic acid);
N-hydroxyethyl,N,N',N'-ethylene diamine tris(methylene phosphonic acid);
2-hydroxypropylene diamine N,N',N,N'-tetra(methylene phosphonic acid);
di(2-hydroxypropylene)triamine penta(methylene phosphonic acid); and
tri(2-hydroxypropylene) tetraamine hexa(methylene phosphonic acid).

30. An etching liquid as set forth in claim 26 wherein the amine moiety of the amine salt is selected from the group consisting of primary, secondary and tertiary branched, unbranched, saturated and unsaturated amines and saturated cyclic amines.

31. An etching liquid as set forth in claim 30 wherein the amine moiety of the amine salt is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

32. An etching liquid as set forth in claim 31 wherein the amine moiety of the amine salt is present in an amount of from 0.1 to 10 grams per liter of etching liquid.

33. An etching liquid as set forth in claim 30 wherein the polycarboxylic acid is selected from the group consisting of citric acid, malic acid, adipic acid, maleic acid, succinic acid, and azelaic acid.

34. A filming agent for use with a strong inorganic acid etching liquid for etching bare areas of a magnesium plate, other portions of which are covered with an etch-resist pattern, said filming agent comprising I. at least one liquid fatty monocarboxylic acid having from 6 to 26 carbon atoms and substantially nonreactive with the inorganic acid,
II. at least one organophosphonic acid,
III. at least one alkylaryl sulfonic acid,
IV. at least one surfactant or coupling agent, and
V. water.

35. A filming agent as set forth in claim 34 wherein components (I) – (IV) are present in amounts such that when the filming agent is added to the etching liquid the amounts of the components are per liter of etching liquid: (I) from 1 to 25 grams; (II) from 1 to 10 grams; (III) from 1 to 10 grams; and (IV) from 3 to 40 grams.

36. A filming agent as set forth in claim 35 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

37. A filming agent as set forth in claim 36 wherein the organophosphonic acids are selected from the group consisting of:

methylene diphosphonic acid;
1-hydroxyethane 1,1-diphosphonic acid;
nitrilo tris(methylene phosphonic acid);
N-carboxymethyl,N,N-di(methylene phosphonic acid);
hexamethylenediamine tetra(methylene phosphonic acid);
ethylenediamine tetra(methylene phosphonic acid);
diethylenetriamine penta(methylene phosphonic acid);
N,N-di(carboxymethyl) N-methylene phosphonic acid;
N-(2-hydroxyethyl) N,N-di-(methylene phosphonic acid);
N-hydroxymethyl,N,N′,N′-ethylene diamine tris(-methylene phosphonic acid);
N-hydroxyethyl,N,N′,N′-ethylene diamine tris(methylene phosphonic acid);
2-hydroxypropylene diamine N,N′,N,N′-tetra(methylene phosphonic acid);
di(2-hydroxypropylene)triamine penta(methylene phosphonic acid); and
tri(2-hydroxypropylene) tetraamine hexa(methylene phosphonic acid).

38. A filming agent as set forth in claim 35 which further includes at least one acyclic or alicyclic amine having at least 6 carbon atoms, there being essentially absent from the filming agent sulfonates and sulfates of fatty monocarboxylic acids.

39. A filming agent as set forth in claim 38 wherein the amine is selected from the group consisting of primary, secondary and tertiary branched, unbranched, saturated and unsaturated amines and saturated cyclic amines.

40. A filming agent as set forth in claim 39 wherein the amine is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

41. A filming agent for use with a strong inorganic acid etching liquid for etching bare areas of a magnesium plate, other portions of which are covered with an etch-resist pattern, said filming agent comprising I. at least one liquid fatty monocarboxylic acid having from 6 to 26 carbon atoms and substantially nonreactive with the inorganic acid,
II. at least one organophosphonic acid,
III. at least one alkylaryl sulfonic acid,
IV. at least one surfactant or coupling agent,
V. at least one acyclic or alicyclic amine having at least 6 carbon atoms, and there being essentially absent from the etching liquid sulfonates and sulfates of fatty monocarboxylic acid, and
VI. water.

42. A filming agent as set forth in claim 41 wherein components (I) – (V) are present in amounts such that when the filming agent is added to the etching liquid the amounts of the components are per liter of etching liquid: (I) from 1 to 25 grams; (II) from 1 to 10 grams; (III) from 1 to 10 grams; (IV) from 3 to 40 grams; and (V) from 0.1 to 10 grams.

43. A filming agent as set forth in claim 42 wherein the organophosphonic acid is selected from the group consisting of organic phosphonic acids having two phosphonic acid groups attached to the same carbon atom aminomethylene-phosphonic acids in which at least one of the nitrogen atoms has at least one methylene phosphonic acid group attached thereto.

44. A filming agent as set forth in claim 43 wherein the organophosphonic acids are selected from the group consisting of:

methylene diphosphonic acid;
1-hydroxyethane 1,1diphosphonic acid;
nitrilo tris(methylene phosphonic acid);
N-carboxymethyl,N,N-di(methylene phosphonic acid);
hexamethylenediamine tetra(methylene phosphonic acid);
ethylenediamine tetra(methylene phosphonic acid);
diethylenetriamine penta(methylene phosphonic acid);
N,N-di(carboxymethyl) N-methylene phosphonic acid;
N-(2-hydroxyethyl) N,N-di-(methylene phosphonic acid);
N-hydroxymethyl,N,N′,N′-ethylene diamine tris(-methylene phosphonic acid);
N-hydroxyethyl,N,N′,N′-ethylene diamine tris(methylene phosphonic acid);

2-hydroxypropylene diamine N,N',N,N'-tetra(methylene phosphonic acid);
di(2-hydroxypropylene)triamine penta(methylene phosphonic acid); and
tri(2-hydroxypropylene) tetramine hexa(methylene phosphonic acid).

45. A filming agent as set forth in claim 41 wherein the amine is selected from the group consisting of primary, secondary and tertiary branched, unbranched, saturated and unsaturated amines and saturated cyclic amines.

46. A filming agent as set forth in claim 45 wherein the amine is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

47. A filming agent for use with a strong inorganic acid etching liquid for etching bare areas of a magnesium plate, other portions of which are covered with an etch-resist pattern, said filming agent comprising I. at least one liquid fatty monocarboxylic acid having from 6 to 26 carbon atoms and substantially nonreactive with the inorganic acid,
II. at least one polycarboxylic acid having from 2 to 10 carbon atoms,
III. at least one alkylaryl sulfonic acid,
IV. at least one surfactant or coupling agent,
V. at least one acyclic or alicyclic amine having atleast 6 carbon atoms, and there being essentially absent from the etching liquid sulfonates and sulfates of fatty monocarboxylic acids, and
VI. water.

48. A filming agent as set forth in claim 47 wherein components (I) – (V) are present in amounts such that when the filming agent is added to the etching liquid the amounts of the components are per liter of etching liquid: (I) from 1 to 25 grams; (II) from 1 to 10 grams; (III) from 1 to 10 grams; (IV) from 3 to 40 grams; and (V) from 0.1 to 10 grams.

49. A filming agent as set forth in claim 48 wherein the amine is selected from the group consisting of primary, secondary and tertiary branched, unbranched, saturated and unsaturated amines and saturated cyclic amines.

50. A filming agent as set forth in claim 49 wherein the amine is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

51. A filming agent for use with a strong inorganic acid etching liquid for etching bare areas of a magnesium plate, other portions of which are covered with an etch-resist pattern, said filming agent comprising I. at least one liquid fatty monocarboxylic acid having from 6 to 26 carbon atoms and substantially nonreactive with the inorganic acid,
II. at least one organophosphonic acid and at least one polycarboxylic acid having from 2 to 10 carbon atoms,
III. at least one alkylaryl sulfonic acid,
IV. at least one surfactant or coupling agent,
V. at least one acyclic or alicyclic amine having at least 6 carbon atoms, and there being essentially absent from the etching liquid sulfonates and sulfates of fatty monocarboxylic acids, and
VI. water.

52. A filming agent as set forth in claim 51 wherein components (I) – (V) are present in amounts such that when the filming agent is added to the etching liquid the amounts of the components are per liter of etching liquid: (I) from 1 to 25 grams; (II) from 1 to 10 grams; (III) from 1 to 10 grams; (IV) from 3 to 40 grams; and (V) from 0.1 to 10 grams.

53. A filming agent as set forth in claim 52 wherein the organophosphonic acid is selected from the group consisting of organic phosphonic acids having two phosphonic acid groups attached to the same carbon atom and aminomethylene-phosphonic acids in which at least one of the nitrogen atoms has at least one methylene phosphonic acid group attached thereto.

54. A filming agent as set forth in claim 53 wherein the organophosphonic acids are selected from the group consisting of:

methylene diphosphonic acid;
1-hydroxyethane 1,1-diphosphonic acid;
nitrilo tris(methylene phosphonic acid);
N-carboxymethyl,N,N-di(methylene phosphonic acid);
hexamethylenediamine tetra(methylene phosphonic acid);
ethylenediamine tetra(methylene phosphonic acid);
diethylenetriamine penta(methylene phosphonic acid);
N,N-di(carboxymethyl) N-methylene phosphonic acid;
N-(2-hydroxyethyl) N,N-di-(methylene phosphonic acid);
N-hydroxymethyl,N,N',N'-ethylene diamine tris(methylene phosphonic acid);
N-hydroxyethyl,N,N',N'-ethylene diamine tris(methylene phosphonic acid);
2-hydroxypropylene diamine N,N',N,N'-tetra-(methylene phosphonic acid);
di(2-hydroxypropylene)triamine penta(methylene phosphonic acid); and
tri(2-hydroxypropylene) tetraamine hexa(methylene phosphonic acid).

55. A filming agent as set forth in claim 51 wherein the amine is selected from the group consisting of primary, secondary and tertiary branched, unbranched, saturated and unsaturated amines and saturated cyclic amines.

56. A filming agent as set forth in claim 55 wherein the amine is selected from the group consisting of primary octyl amine, secondary octyl amine, tertiary octyl amine, 2-ethyl hexyl amine, tri(n-propyl) amine, cyclohexyl amine, dicyclohexyl amine, monohexadecyl amine, dibutyl amine, 5-aminononane, oleyl amine, mono(n-hexyl) amine, di(n-hexyl) amine, n-nonyl amine, and n-dodecyl amine.

* * * * *